United States Patent [19]

Blain

[11] Patent Number: 4,601,366

[45] Date of Patent: Jul. 22, 1986

[54] DOWN VALVE FOR THE DOWN SPEED CONTROL OF A HYDRAULIC ELEVATOR

[76] Inventor: Roy W. Blain, Pfaffenstrasse 1, D-7100 Heilbronn, Fed. Rep. of Germany

[21] Appl. No.: 600,582

[22] Filed: Apr. 17, 1984

[30] Foreign Application Priority Data

Apr. 25, 1984 [DE] Fed. Rep. of Germany ..... 3314657

[51] Int. Cl.[4] ..... F15B 13/042

[52] U.S. Cl. ..... 187/17; 187/28; 187/68; 137/505.13; 91/443

[58] Field of Search ..... 187/17, 28, 68; 137/495, 505.13; 91/443, 445, 447

[56] References Cited

U.S. PATENT DOCUMENTS

| | | | |
|---|---|---|---|
| 2,737,197 | 3/1956 | Jaseph | 187/17 |
| 2,785,660 | 3/1957 | Jaseph | 137/505.13 X |
| 2,888,909 | 6/1959 | Gratzmuller | 91/443 X |
| 2,988,060 | 6/1961 | Arbogast et al. | 91/443 |
| 4,153,074 | 5/1979 | Risk | 187/17 X |

*Primary Examiner*—Joseph J. Rolla
*Assistant Examiner*—Nils E. Pedersen
*Attorney, Agent, or Firm*—Eugene Chovanes

[57] ABSTRACT

A down valve (1) consists of a sealing spool device (6) which in its closed position separates a pressure chamber (3), which is connected with the elevator hydraulic cylinder (9), from a return flow chamber (5). The sealing spool device (6) includes a sealing plug (32) which seals off the two chambers (3 and 5) and a metering plug (33) which is intended for the connecting of the two chambers (3 and 5). The return flow orifices (51) are governed by a control edge (57). The metering plug (33) is influenced toward a given position relative to the sealing spool (6) by pressure in a positioning chamber (44) against the force of a compensating spring (56) such that the return flow orifices (51) are choked down. The operating pressure present in the pressure chamber (3) is fed through the pressure sensing orifice (46) to the positioning chamber (44).

7 Claims, 9 Drawing Figures

FIG. 2
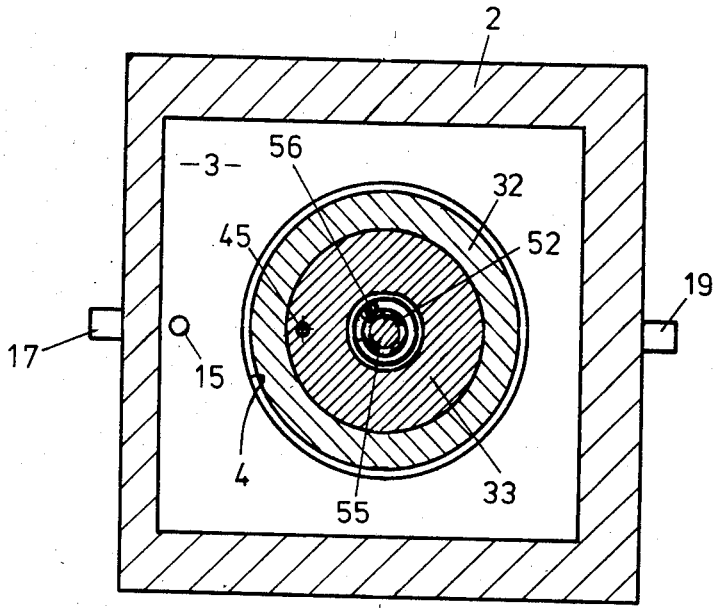
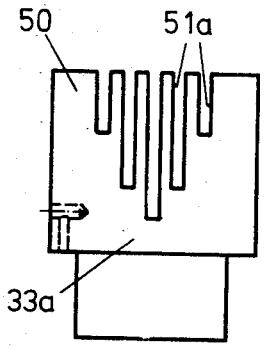
FIG. 3
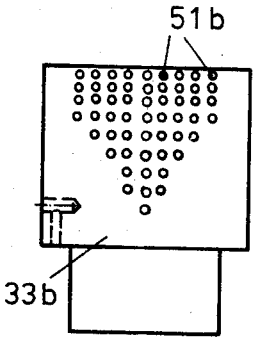
FIG. 5
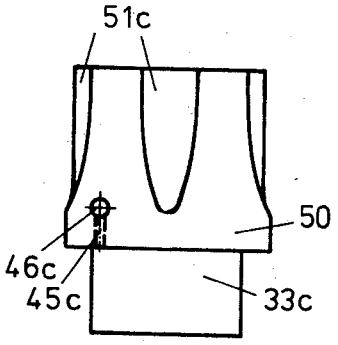
FIG. 7
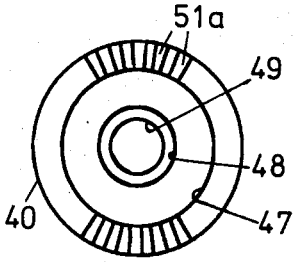
FIG. 4
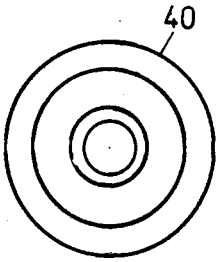
FIG. 6
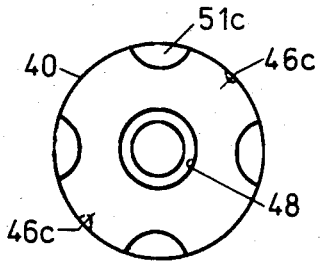
FIG. 8

DOWN VALVE FOR THE DOWN SPEED CONTROL OF A HYDRAULIC ELEVATOR

STATEMENT OF THE INVENTION

The present invention concerns a down valve to control the downwards speed of an hydraulic elevator, consisting of a housing with a pressure chamber connected to the elevator cylinder and a return chamber separated from each other by a sealing spool, which sealing spool is forced towards its closed position by a spring and towards its open position by the hydraulic pressure in the pressure chamber and which is equipped with a metering annex whose outside circumference, depending on the position of the spool and in relation to a control edge between the pressure and the return chambers, serves to control the opening and closing of the return orifices which lie in the circumference of the metering plug which itself is movable in the same axial direction as, and relative to, the sealing spool.

BRIEF DESCRIPTION OF THE PRIOR ART

A similar down valve is already known wherein for a downwards travel of the elevator, the sealing spool is lifted from its seat through a differential pressure acting upon it against the force of a spring. The down speed is dependent thereby on the area of the return orifice on the sealing spool. Through an adjustable stopscrew which limits the opening of the sealing spool, the effective area of the return orifice, and thereby the down speed of the elevator can be adjusted.

Nevertheless, in spite of the unaltered setting of the stopscrew there is no assurance that the down speed of the elevator remains unchanged. Differing speeds can result according to the loading of the elevator, which can vary between full and empty load. An increase in load causes the hydraulic operating pressure to rise which is effective in the pressure chamber of the down valve. In this case, the pressure differences acting on the return flow orifice increases leading to an increased down speed of the elevator. This is undesirable, rather the opposite can be the requirement so that by increased loading of the elevator a reduced down speed results.

The problem of load dependent variations of the down speed has already been countered by a balancing spool built into the down valve so that the sealing spool opens only so far that a previously selected pressure differences is maintained between two chosen points in the flow return line of the hydraulic fluid. This pressure difference is dependent upon the flow speed of the fluid so that this flow speed is controlled by a previously selected value. For example, by increasing load, the sealing spool is choked down by the balancing spool so that a load dependent increase in the down speed is countered.

The known down valve with built in balancing spool is more expensive due to its construction and is comparatively troublesome and difficult to adjust. In addition there is an increase in sealing points and in servicing costs. Finally, it is not possible to over-compensate in that an increase in elevator load results in a decrease in down speed.

It is also known how to exclude load dependence by means of electronic control. Thereby, the flow of hydraulic fluid from the elevator cylinder is measured and compared with the programmed value whereby discrepancies initiate corrective signals which regulate the down valve to the programmed value. Obviously, this solution involves problems of expense, break-downs and intensive servicing.

SUMMARY OF THE INVENTION

The purpose of the present invention is to improve the initially known design such that in a constructively simple and at the same time trouble free way, an increase in the down speed through increased elevator load is prevented to the point of being able to reduce down speed by increased elevator load.

The task is inventively solved in that the sealing spool is made up of a sealing plug and a metering plug terminating in a metering annex which is united with an 'in and out' movable piston within a positioning chamber of the sealing spool and which is exerted upon by a compensating spring acting against the extruding pressure in the positioning chamber which is connected to the operating pressure by a pressure sensing orifice.

With this construction, although the sealing plug, responsible for the sealing of the pressure chamber from the return flow chamber, during opening transports the metering plug with the return flow orifice so that this is opened at the control edge, there occurs an additional pressure dependent regulation of the return flow orifice such that a relative movement occurs between the sealing plug and metering plug which is acted upon by the load dependent pressure in the positioning chamber against the force of the compensating spring, causing a return closing. This return closing due to the relative movement between the sealing plug and the metering plug is greater as the load dependent pressure increases. Thereby, through a simple inexpensive arrangement the effect of the elevator load on the down speed is compensated. The simplicity of construction is also the reason for its trouble free operation and ease of servicing.

Obviously, the degree to which the return flow orifice closes, counter to the opening movement of the sealing plug can be influenced to suit actual requirements by the shape, size and arrangement of the flow return orifice on the metering annex as well as the sizing of the piston areas of the metering plug acted upon by the pressure in the positioning chamber, and the strength of the compensating spring. In particular, an over compensation can be achieved such that the down speed be reduced by increasing elevator load. Various degrees of dependancy of the down speed on the elevator load can be obtained by exchanging the metering plug with another metering plug with differing shape, size or arrangement.

A further advantage of the invention is that in a similarly simple way as the exchanging of the metering plug, the existing down valve without load compensation can be re-equipped by exchanging the one piece sealing spool for a sealing plug with a separate pressure-dependent regulated closable metering plug.

The pressure sensing orifice can be situated in various positions and be acted upon by the operating pressure in differing stages of the opening movement. A first, particularly advantageous arrangement in respect to the simplicity of the construction and good sealing, is with the pressure sensing orifice in such a position on the sealing spool that it moves out of a position where it is sealed off from the pressure chamber into a position connected with the pressure chamber as the sealing spool opens. Thus in the closed position, the positioning chamber is sealed off from the operating pressure so that for this chamber no special sealing is required, however compensation only becomes effective after the opening movement begins, which is adequate for many applications.

According to a first embodiment, the pressure sensing orifice is positioned in the circumferential face of the metering extention, connected with the positioning chamber through a channel and governed by the control edge otherwise for the regulating of the return flow orifice. In this case, no additional sealing measures are required to avoid a leakage of hydraulic fluid through the positioning chamber. With the sealing plug in its closed position, the positioning chamber is also closed off from the pressure chamber by the seal. Pressure acts upon the pressure sensing orifice and thereby in the positioning chamber by opening the sealing plug and no other measure in required.

The channel connecting the pressure sensing orifice with a positioning chamber can be a slot in the circumferential face of the metering annex. The production of the metering plug can thereby be simplified without detriment to the function.

Further, it has proven to be expedient when the pressure sensing opening is positioned in the region of the pressure chamber side of the return line orifice or end of the return line orifice. This has the effect of a pressure dependent closing of the return line orifice as soon as the return line orifice begins to open resulting from the opening of the down valve, so that from the beginning, the down movement of the elevator is compensated and not first when the adjusted down speed, is reached.

According to a second embodiment, the pressure sensing opening is in the circumferential face of the sealing piece and leads into the pressure chamber in all positions. Then the metering plug can already take up its new position as the elevator is loaded and not first when the pressure sensing orifice has been exposed through the opening of the sealing body. Therefore there is no reversing of the metering plug to be felt in the travel characteristics during the acceleration phase of the elevator.

To avoid undesirable oil leakage out of the positioning chamber. over the circumferential faces which would lead to a slow sinking of the elevator, appropriate sealing is provided such that the piston of the metering plug is sealed and guided in its bores with its seals being effective through the operating pressure and with the channel connected with the pressure sensing orifice leading into the positioning chamber between these seals. The additional expense for the sealing is justified by the improved travel characteristics.

BRIEF DESCRIPTION OF THE DRAWING

Examples of the construction of the invention as well as the possible varying forms of the metering plug will be more closely explained on hand from the drawing, in which

FIG. 2 is a horizontal section along lines 2—2 in FIG. 1.

FIG. 3 is a side view of an alternative metering plug.

FIG. 4 is a plan view of the metering plug as in FIG. 3.

FIG. 5 is a side view of a further alternative metering plug.

FIG. 6 is a plan view of the metering plug as in FIG. 5.

FIG. 7 is a side view of still a further alternative metering plug.

FIG. 8 is a plan view of the metering plug as in FIG. 7.

DETAILED DESCRIPTION

Figure 1:
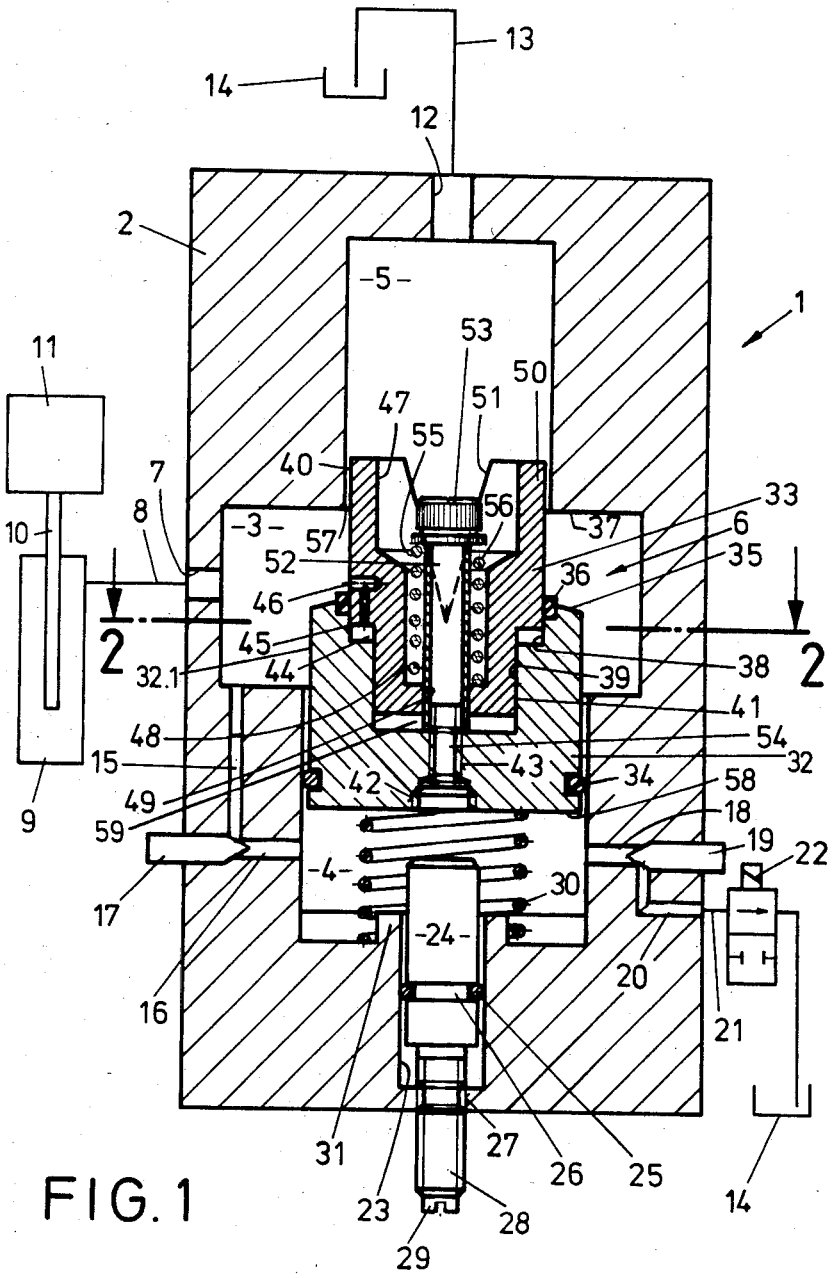
FIG. 1 is a vertical cross section of the down valve according to a first embodiment of the invention wherein the connected elevator is shown in reduced size.

The down valve 1 includes a housing 2 containing a pressure chamber 3 connected with the reverse pressure chamber 4 by means of the restrictor channel 16 into which restrictor 17 is fitted. The restrictor 17 is adjustable and allows the restrictor orifice between the pressure chamber 3 and the reverse chamber 4 to be adjusted.

The reverse pressure chamber 4 is connected with the collector tank or sump 14 via restrictor channel 18 which is also fitted with an adjustable restrictor 19, an angled return channel 20 and a return line 21. The return line 21 is opened and closed by a solenoid valve 22.

A bore extension 23 of the reverse pressure chamber 4 contains the stop screw 24 for the sealing spool means 6. An o-ring 25 in the circumferential groove 26 of the stop screw 24 seals the back or under side of the bore extension 23 from the reverse pressure chamber 4. This sealed end of the bore extension 23 passes into the outer face of the housing 2 in the form of the threaded bore 27 in which the thread bolt 28 at the bottom end of the stop screw 24 is adjustably screwed. This produces an adjustment section 29 at its outer end for inserting a turning key. Herewith, the stop screw 24 can be axially moved and thereby the fully open position of the sealing spool means 6 adjusted.

The sealing spool means 6 is held in its closed position by a spiral pressure spring 30. The spiral pressure spring 30 is positioned in the reverse pressure chamber 4 and centered by the collar 31 surrounding the screw stop 24.

The sealing spool means 6 includes a sealing plug or spool 32 and a separately constructed metering plug 33. The sealing plug 32 slides with its cylindrical circumferential face 32.1 in the corresponding cylindrical reverse pressure chamber 4 whereby an o-ring 34 is set in the circumferential face 32.1 which seals off the pressure chamber 4. The sealing plug 32 posesses a sealing ring 36 in the region of the circular face of the front edge 35 which seals on the seat face 37 when sealing spool means 6 is in its closed position. This seat 37 circumscribes the opening which leads from the return chamber 5, being cylindrical and co-axial to the reverse pressure chamber 4, to the pressure chamber 3. In the closed position, the sealing ring 36 is relieved of the closing force in that the front edge 35 of the sealing plug 32 also presses against the seat face 37 of the housing 2.

The sealing plug 32 seen from the upper end includes an end bore 38 and an inner counterbore 39 of lesser diameter. The bores 38 and 39 form bearing faces for the correspondingly stepped metering plug or spool 33 with its circumferential faces 40 and 41' respectively. A central outer thread bore 42 which leads into an inner thread bore 43 is positioned at the lower front face of the sealing plug 32.

Between the radial areas of the bores 38 and 39 of the sealing plug 32 or otherwise the circumferential faces 40 and 41 of the metering plug 33, is a positioning chamber 44 which is connected via channel 45 to a pressure sensing orifice 46 in the circumferential face 40 of the metering plug 33.

Seen from the upper end, the metering plug 33 consists of an end bore 47, an inner counterbore 48 of lesser diameter, and a still narrower through bore 49. The upper end of the metering plug 33 consists mainly of a cylindrical metering annular portion 50 in which two diametrically opposite basically V-shaped return orifices 51 are situated reaching from the outer circumferential area radially through to the bore 47 and as far as bore 48.

The travel of the metering plug 33 in relation to the sealing plug 32 is limited by means of a securing bolt 52 with a knurled head 53 in that its lower threaded section 54 is screwed into the inner thread bore 43 of the sealing plug 32. A spacing sleeve 55 which slides in the rear bore 49 of the metering plug is fitted over the securing bolt 52. A compensating spring 56 in the form of a spiral pressure spring which is positioned on the outside of the spacing sleeve 55, is supported between the rear of the metering plug 33 and the knurled head 53 of the securing bolt 52. The metering plug 33 is thereby pressed towards a reduction of the positioning chamber 44 in the direction of the sealing plug.

A control edge 57 is situated at the entrance of the return chamber 5 to the pressure chamber 3 which in the shown position of the sealing spool 6 in FIG. 1, determines the lower return orifice 51 through which oil flows out of the pressure chamber 3 into the return chamber 5.

According to FIGS. 3 and 4, a metering plug 33*a* can be employed instead of metering plug 33, in which case the return orifices are made up of return slots 51*a* which lead from the upper front face of the metering plug 33*a* in differing lengths.

According to FIGS. 5 and 6 the return orifice is in the form of radial bored holes 51*b* which are in differing quantities in differing row lengths.

FIGS. 7 and 8 show an alternative metering plug 33*c* whereby the outer bore 47 is omitted and the return flow orifice is in the form of four return flow recesses 51*c* arranged arount the circumference and which run axially to the inner bore 48 whereby the return flow recesses 51*c* become wider and deeper towards the upper face of the metering plug 33*c*. Further, the pressure sensing orifice 46*c* in this arrangement is not connected with the ring face of the positioning chamber 44 by means of a bore but rather than a groove 45*c* in the circumferential face of the metering extention 50. As is seen from FIG. 8, two pressure sensing orifices 46*c* with grooves 45*c* are positioned diametrically opposite between a pair of return flow recesses 51*c*.

Instead of the return flow orifice 51 being in the form of return flow slots 51*a*, return flow holes 51*b* or return flow recesses 51*c*, the metering extension 50 can be conical over the complete length of its circumferential face 40 in order to achieve the same reduction in sectional area.

The circumferential face can also be shaped such that it is initially cylindrical becoming then conical or tapering out in some other suitable form.

OPERATION

The down valve 1 is operable in the following manner: Before the downwards travel of the elevator 11, the solenoid valve 22 is closed. Therefore the operating pressure in the pressure chamber 3 is also acting in the reverse pressure chamber 4 since the restrictor 17 does not block the connection between the two chambers and the reverse pressure chamber is closed off to the collector tank 14. Thereby, a closing force acts on the front face 58 of the sealing plug 32 which is larger than the opening force acting on the annulus area of the upper front face 35 of the sealing plug 32. The resulting closing force in connection with the spiral pressure spring 30 ensures that the sealing plug 32 with its sealing ring 36 is pressed against the seat face 37, whereby the low pressure present in the return chamber acts on the pressure sensing opening orifice 46 and thereby in the positioning chamber 44.

Accordingly the metering plug 33 responding to the force of the compensating spring 56 is fully retracted into the sealing plug 32.

For a down travel of the elevator 11 the solenoid valve 22 opens as shown in FIG. 1. Since the restriction of restrictor 17 is arranged to be less than that of restrictor 19 the pressure in reverse pressure chamber 4 drops towards that of the return flow pressure so that the opening force acting on the upper front edge 35 of the sealing spool 32 exceeds that of the spiral pressure spring 30 thus lifting the sealing spool from the seat face 37 whereby the metering plug 33 is also transported as shown in FIG. 1. Accordingly the return flow orifices 51 at their lower end, move past the control edge 57 and are thereby controlled in such a way that oil flows out of the pressure chamber 3 into the return flow chamber 5 and thereby into the collector tank 14. A metered return flow results according to the degree of opening of the return flow orifices 51 reaching its maximum when the front face 58 of the sealing spool 32 contacts the stop screw 24. The volume of the return flow determines the downwards speed of the elevator. However, varying elevator loads lead to varying oil pressure in pressure chamber 3 so that even in the same position of the metering extention 50 and thereby the same opening of the return flow opening 51, the return flow can take place with varying volume resulting in varying that is to say, load-dependant down speeds.

This is countered by down valve 1 in that after the lowering of sealing spool 32 from the seat face 37, instead of the return flow pressure, the operating pressure from the pressure chamber 3 is lead to positioning chamber 44 through the pressure sensing orifice 46.

This acts on the annulus of the metering plug 33 which borders the positioning chamber 44. The return flow pressure acting on the lower face of the metering plug 33 which borders the back chamber 59 of the sealing spool 32 remains unchanged since the securing bolt 52 and spacing sleeve 55 are designed with play within the rear bore 49 of the metering plug 33 so that a vent connection between the back chamber 59 and the return flow chamber 5 remains.

Following the lowering of the sealing spool 32 from seat surface 37, the operating pressure acting within the positioning chamber 44 causes a limited return of the metering plug 33 alone, against the force of the compensating spring 56 which results in a closing of the return flow orifice 51. This closing force increases oil pressure in the pressure chamber 3 so that the outlet area available for the return flow becomes accordingly reduced. The volume of oil flow is thereby automatically choked back and the elevator load, to a larger or lesser degree, compensated.

It is evident that a complete load compensation or even an overcompensation in the way of a reduction of the down speed by increased load can be achieved when the relationship of the circumferential faces 40 and 41 of the metering plug 33 are selected such that the metering plug area in the positioning chamber 44 being acted upon by the operating pressure is of corresponding size to the compensating spring 56 so that the metering plug 33 advances in the correct relationship to the sealing spool 32.

Figure 9:
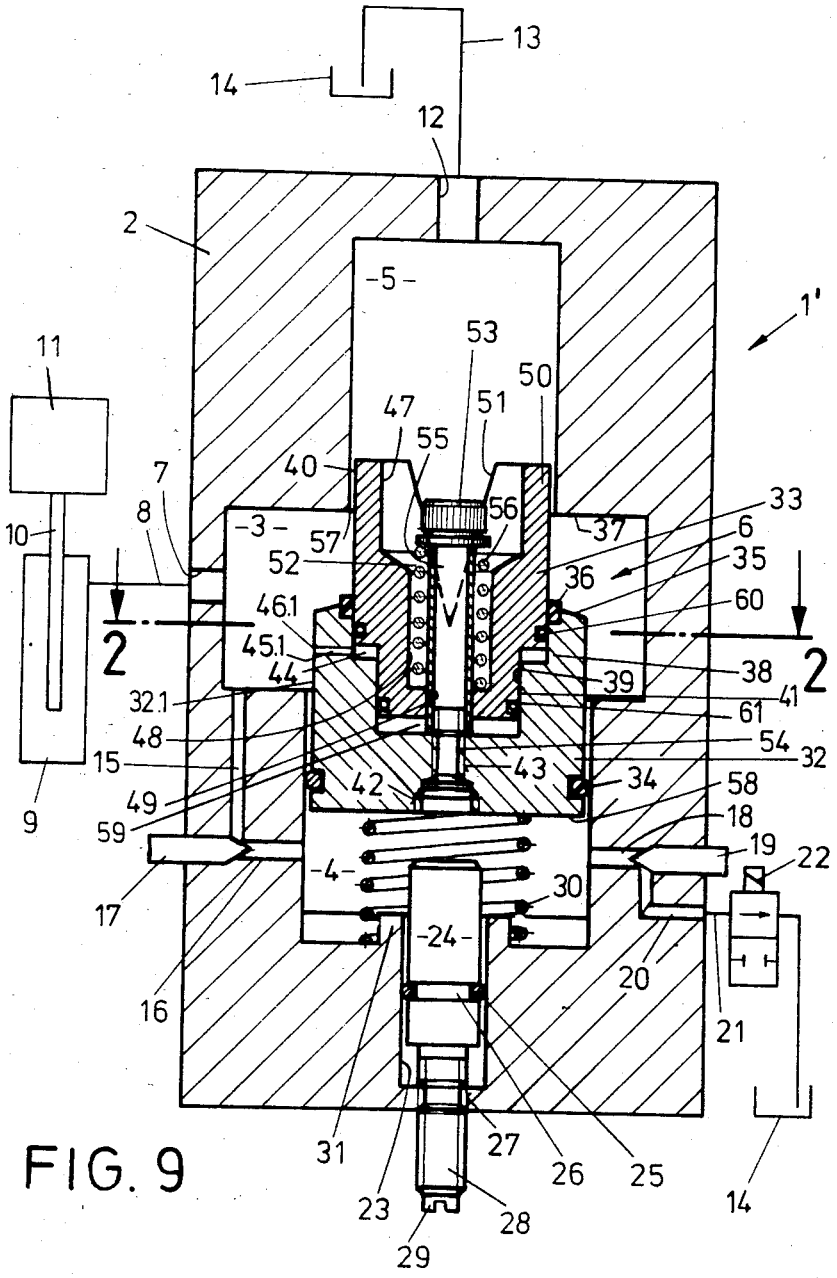
FIG. 9 is a second embodiment of the invention wherein the pressure sensing opening leads to the pressure chamber in all positions.

FIG. 9 shows a down valve 1' which for the main part conforms to FIG. 1 and whose parts can also mostly be of the forms according to FIGS. 3 to 8. The same parts carry the same nomenclature.

The difference of this example to the previous design is that the metering plug 33 is sealed with an o-ring seal 60 in the end bore 38 and with an o-ring seal 61 in the counterbore 39 whereby the seals are so arranged that by full operating pressure no oil leaks from the pressure chamber 3 to the return flow chamber 5, even in the sealing position of the sealing spool 6.

A further difference to the first design example is that the pressure sensing orifice 46.1 of the channel 45.1 is not arranged in the outer circumferential face 40 of the metering plug 33 but rather in the outer circumferential face 32.1 of the sealing plug 32 leading into the pressure chamber 3 in all positions so that the pressure in the pressure chamber 3 is always acting in the positioning chamber 44 thus forcing the metering plug 33 to its appropriate position against the effect of the compensating spring 56. It is thereby achieved that already as the valve opens, the metering plug 33 is in its pressure compensated operating position. Through this measure a considerable improvement of the travel characteristic during the accelerating phase of the elevator is accomplished. The layout of the position of the orifices and the seals can vary, however it is important that the metering plug 33 at any given time depending on the prevailing pressure, is so adjusted that the desired smooth travel characteristics of the elevator are obtained.

What is claimed is:

1. A down valve for controlling the downward speed of a hydraulic elevator, comprising (a) a housing (1) containing a pressure chamber (3), and longitudinally-arranged cylindrical reverse pressure (4) and return chambers (5) contained in opposite end walls of said pressure chamber, respectively, said housing including an inlet (7) for connecting said pressure chamber with a hydraulic elevator cylinder (9), and first (20) and second (12) outlets for connecting said reverse pressure and return chambers with a sump (14), respectively;

(b) a sealing spool (32) slidably mounted in said reverse pressure chamber, said sealing spool containing in the end thereof adjacent said return chamber an end bore (38) and an inner counterbore (39);

(c) first spring means (30) biasing said sealing spool toward a closed position in sealed engagement with the one pressure chamber end wall (37) that contains said return chamber, thereby to isolate said pressure chamber from said return chamber;

(d) a stepped metering spool (33) having at one end first (40) and second (42) portions slidably mounted in said sealing spool end bore and counterbore, respectively, said metering spool having at its other end an annular portion (50) that extends within said return chamber, said annular portion containing adjacent its free extremity means defining at least one longitudinally extending return metering passage (51) the effective size of which progressively decreases in the direction away from said return chamber;

(e) second spring means (56) biasing said metering spool away from said sealing spool in the direction of said return chamber;

(f) by-pass passage means (15,16) connecting said pressure chamber with said reverse pressure chamber, said sealing spool being in its closed position relative to said pressure chamber one end wall when said first outlet is closed, said sealing spool being displaced, when said first outlet is opened, by the pressure of fluid in said pressure chamber toward an open position relative to said one pressure chamber end wall; and (g) positioning passage means (45,45.1) including a pressure sensing orifice (46,46.1) contained in one of said sealing and metering spools for connecting said pressure chamber with the positioning chamber (44) defined between the end wall of said sealing spool end bore and the adjacent annular end surface of said first stepped portion of said metering spool, and vent passage means (49, 55) connecting with said return chamber the back chamber (59) defined between the end wall of said sealing spool counterbore and the adjacent end surface of said metering spool second portion, whereby the pressure fluid supplied to said positioning chamber via said pressure sensing orifice displaces said metering spool relative to said sealing spool toward a pressure-responsive metering position with respect to said pressure chamber one end wall surface, thereby to effect load-compensated down speed of the elevator.

2. A down valve for controlling the downward speed of a hydraulic elevator, comprising (a) a housing (1) containing a pressure chamber (3), and longitudinally-arranged cylindrical reverse pressure (4) and return chambers (5) contained in opposite end walls of said pressure chamber, respectively, said housing including an inlet (7) for connecting said pressure chamber with a hydraulic elevator cylinder (9), and first (20) and second (12) outlets for connecting said reverse pressure and return chambers with a sump (14), respectively;

(b) a sealing spool (32) slidably mounted in said reverse pressure chamber, said sealing spool containing in the end thereof adjacent said return chamber an end bore (38) and an inner counterbore (39);

(c) first spring means (30) biasing said sealing spool toward a closed position in sealed engagement with the one pressure chamber end wall (37) that contains said return chamber, thereby to isolate said pressure chamber from said return chamber;

(d) a stepped metering spool (33) having at one end first (40) and second (42) portions slidably mounted in said sealing spool end bore and counterbore, respectively, said metering spool having at its other end an annular portion (50) that extends within said return chamber, said annular portion containing adjacent its free extremity means defining at least one longitudinally extending return metering passage (51) the effective size of which progressively decreases in the direction away from said return chamber;

(e) second spring means (56) biasing said metering spool away from said sealing spool in the direction of said return chamber;

(f) by-pass passage means (15,16) connecting said pressure chamber with said reverse pressure chamber, said sealing spool being in its closed position relative to said pressure chamber one end wall when said first outlet is closed, said sealing spool being displaced, when said first outlet is opened, by the pressure of fluid in said pressure chamber toward an open position relative to said one pressure chamber end wall; and (g) positioning passage means (45) including a pressure sensing orifice (46) contained in one of said sealing and metering spools for connecting said pressure chamber with the positioning chamber (44) defined between the end wall of said sealing spool end bore and the adjacent annular end surface of said first stepped portion of said metering spool, said pressure sensing orifice being arranged, when said sealing spool is in the closed position, within said return chamber in isolated relation relative to said pressure chamber, and vent passage means (49, 55) connecting with said return chamber the back chamber (59) defined between the end wall of said sealing spool counterbore and the adjacent end surface of said metering spool second portion, whereby the pressure fluid supplied to said positioning chamber via said pressure sensing orifice displaces said metering spool relative to said sealing spool toward a pressure-responsive metering position with respect to said pressure chamber one end wall surface, thereby to effect load-compensated down speed of the elevator.

3. Apparatus as defined in claim 2, wherein said metering spool first portion extends in concentrically spaced relation with said return chamber, and further wherein said pressure sensing orifice (46) is contained in the circumferential face of said metering spool first portion, whereby said pressure sensing orifice and said metering passage are both controlled by the control edge (57) of said one pressure chamber wall.

4. Apparatus as defined in claim 3, wherein said positioning passage means includes a groove (45*c*) contained in the circumferential face of said metering plug and extending longitudinally thereof from said orifice to said positioning chamber.

5. Apparatus as defined in claim 2, wherein said pressure sensing orifice is arranged adjacent said return flow orifice.

6. A down valve for controlling the downward speed of a hydraulic elevator, comprising (a) a housing (1) containing a pressure chamber (3), and longitudinally-arranged cylindrical reverse pressure (4) and return chambers (5) contained in opposite end walls of said pressure chamber, respectively, said housing including an inlet (7) for connecting said pressure chamber with a hydraulic elevator cylinder (9), and first (20) and second (12) outlets for connecting said reverse pressure and return chambers with a sump (14), respectively;

(b) a sealing spool (32) slidably mounted in said reverse pressure chamber, said sealing spool containing in the end thereof adjacent said return chamber an end bore (38) and an inner counterbore (39);

(c) first spring means (30) biasing said sealing spool toward a closed position in sealed engagement with the one pressure chamber end wall (37) that contains said return chamber, thereby to isolate said pressure chamber from said return chamber;

(d) a stepped metering spool (33) having at one end first (40) and second (42) portions slidably mounted in said sealing spool end bore and counterbore, respectively, said metering spool having at its other end at annular portion (50) that extends within said return chamber, said annular portion containing adjacent its free extremity means defining at least one longitudinally extending return metering passage (51) the effective size of which progressively decreases in the direction away from said return chamber;

(e) second spring means (56) biasing said metering spool away from said sealing spool in the direction of said return chamber;

(f) by-pass passage means (15,16) connecting said pressure chamber with said reverse pressure chamber, said sealing spool being in its closed position relative to said pressure chamber one end wall when said first outlet is closed, said sealing spool being displaced, when said first outlet is opened, by the pressure of fluid in said pressure chamber toward an open position relative to said one pressure chamber end wall; and (g) positioning passage means (45.1) including a pressure sensing orifice (46.1) contained in said sealing spool for continuously connecting said pressure chamber with the positioning chamber (44) defined between the end wall of said sealing spool end bore and the adjacent annular end surface of said first stepped portion of said metering spool, and vent passage means (49,55) connecting with said return chamber the back chamber (59) defined between the end wall of said sealing spool counterbore and the adjacent end surface of said metering spool secured portion, wherebyr the pressure fluid supplied to said positioning chamber via said pressure sensing orifice displaces said metering spool relative to said sealing spool toward a pressure-responsive metering position with respect to said pressure chamber one end wall surface, thereby to effect load-compensated down speed of the elevator.

7. Apparatus as defined in claim 6, and further including a pair of O-rings (60,61) for sealing the spaces between said metering spool first and second portions and said sealing spool end bore and counterbore, respectively.

* * * * *